United States Patent [19]

Gruchalski et al.

[11] Patent Number: 4,621,553

[45] Date of Patent: Nov. 11, 1986

[54] VERTICAL PIERCE DIE

[76] Inventors: Henry Gruchalski; Albert P. Gruchalski, both of 5737 W. Newport, Chicago, Ill. 60634

[21] Appl. No.: 615,329

[22] Filed: May 30, 1984

[51] Int. Cl.[4] ..... B26D 1/00; B21D 28/28

[52] U.S. Cl. ..... 83/194; 83/54

[58] Field of Search ..... 83/54, 164, 179, 184, 83/187, 188, 192–194, 685–687, 695, 698

[56] References Cited

U.S. PATENT DOCUMENTS 2,325,437 7/1943 Temple ..... 83/194

FOREIGN PATENT DOCUMENTS 2369029 6/1978 France ..... 83/194

46-15074 4/1971 Japan ..... 83/194

*Primary Examiner*—James M. Meister

*Assistant Examiner*—John L. Knoble

*Attorney, Agent, or Firm*—Charles F. Meroni, Jr.

[57] ABSTRACT

A piercing die assembly for punching a plurality of radially extending holes in a tubular member. The assembly having an open end for receiving a tubular member to be punched. The die assembly having structure for supporting the tubular member in a pre-punching position including radially inner and outer die walls for backing up inner and outer wall surfaces of the tubular member to be punched. A plurality of spaced radially movable punch assemblies are operatively connected with the die structure and having a series of radially movable punches. The punch assemblies having bearings positioned at radially outer ends of the punches and each bearing and its associated punch being radially movable simultaneously together. A vertically movable ring-shaped actuator member is positioned radially outwardly of the punches and is movable axially from a pre-punching position to a post-punching position. A plurality of spaced cams are mounted on the ring-shaped actuator member and are movable up and down therewith from a pre-punching position to a post-punching position and with cams being positioned for contacting and actuating the bearings and the punches to punch holes in the tubular member in a preplanned manner. A press is provided for moving the actuator member from its pre-punching position and actuating said cams to actuate the punches to punch the tubular member.

17 Claims, 10 Drawing Figures

FIG. 5
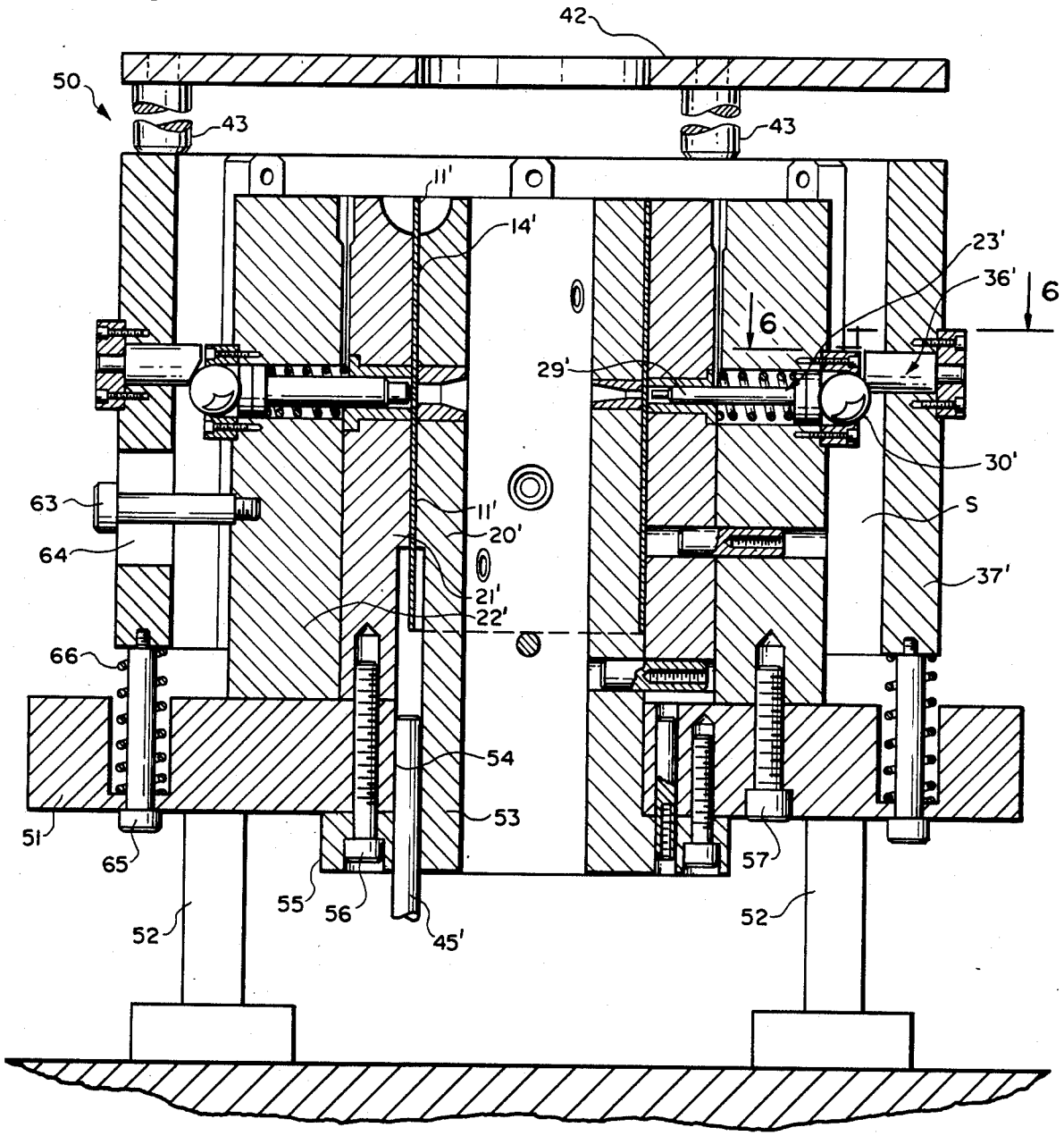
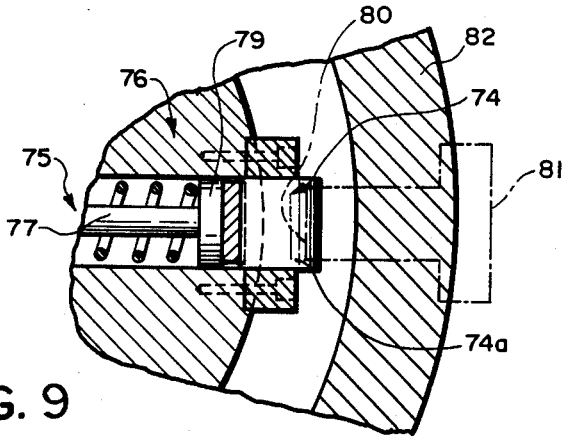
FIG. 9
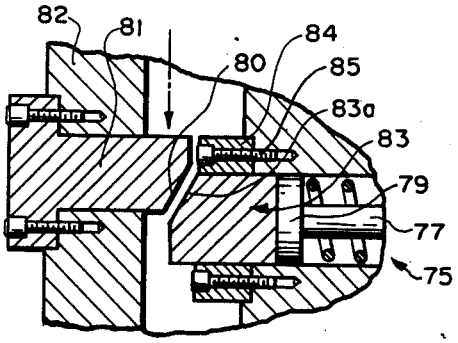
FIG. 10

VERTICAL PIERCE DIE

BACKGROUND OF THE INVENTION

1. Field of the Invention

The present invention relates to a new and improved piercing die assembly for punching a plurality of radially extending holes in a tubular member in a one shot operation whereby the die assembly can pierce as many as one hundred (100) or more holes, or slots, in round and square tubing, cups or metal boxes.

2. Description of the Prior Art

Heretofore, horn dies or indexing dies have been used to punch articles of various types.

Examples of such prior art devices are found in the following U.S. Patents:

| U.S. PAT. NO. | PATENTEE |
|---|---|
| 1,398,320 | Dunsworth |
| 1,503,551 | Nice |
| 1,581,810 | Patrick |
| 2,315,340 | Knudsen |
| 2,326,536 | Hartsock |
| 2,329,020 | Wales |
| 2,419,534 | Burleson |
| 2,423,791 | Nelson |
| 2,630,862 | Musser |
| 2,875,829 | Patrick |
| 3,374,697 | Robinson |
| 3,485,124 | Merchant |
| 3,557,649 | Kirchner |
| 3,579,767 | Reider |
| 3,580,122 | Powell |
| 3,756,108 | Fuchs, Jr. |
| 3,782,231 | Jannetty |
| 3,949,632 | Kappan |
| 4,269,094 | Long, et al |

In the Dunsworth Pat. No. 1,398,320 the basic idea and differences are as follows: This device pierces one configuration or part at a time at a given location, then the machine indexes the part itself to again pierce the same configuration. The moving parts and the action of this machine are totally different for the head reciprocates up and down and is activated by gear driven mechanisms. The location of the configuration is again controlled by the use of gears which means after prolonged use the location may differ from original.

In the Nice U.S. Pat. No. 1,503,551 the basic differences from our construction are as follows: The side pierce action of this machine pushes down on the part which in turn pushes the pad down. The levers 22 are pivoted on rods 21 in the stationary blocks of the machine. Thus, a basic difference exists in this machine whereby an activating lever must be provided for every hole that is to be pierced in the piece part or band. Another problem with a machine of this type is that where the band is of a thicker material, the size of the lever and its pivot must be enlarged for punching which limits the number of holes you can punch into a given sized band.

In Patrick U.S. Pat. No. 1,581,810 the basic idea and differences are as follows: The flywheel which is labeled "s" in the drawing (FIG. 2) is activated by a motor which turns the crank shaft that is connected to a knee. The knee itself is guided below the table. The toggle joint is connected to the knee which is labeled "j" in FIG. 2. When the crank shaft is at the resting or neutral position, the toggle brings the slide back away from the part (FIG. 4). The action is controlled from the bottom and only two punches can be punched at any given time.

In Knudson U.S. Pat. No. 2,315,340, the basic idea and differences are as follows: This device uses the basic slide cam principle to pierce holes. The part and whole assembly are activated by the ram pushing down so that the fixed cylindrical stud "20" in FIG. 1 slides the perf assembly over. The main problem with illustrated construction is that when you have two holes in line perpendicular to the base, it is impossible to punch them at the same time without rotating the part. The patented assembly is limited for it can only produce a limited quantity of holes at limited locations and hence the die assembly has a limited hole producing or punching capacity.

In Hartsock et al U.S. Pat. No. 2,326,536, the basic idea and differences are as follows: This device uses four hydraulic cylinders to pierce four equally spaced holes at one time. This machine is capable of indexing the part but each cylinder is in a fixed location. One of the main differences between this machine and our invention is that the prior art machine can only produce a limited number of holes for the indexing device can only be set for a certain number of degrees.

In the Wales U.S. Pat. No. 2,329,020, the basic idea and differences are as follows: This device uses the slide action principle but provides the user with an advantage of moving any of the units around because of the unique one piece construction of the punch and the die. The same device may be used for a number of different parts. This device is limited to the height of the part and to the thickness of the material.

In the Burleson U.S. Pat. No. 2,419,534, the basic idea and differences are as follows: This device uses a single rack and gear which is connected to an inner ring which has rollers fixed in different locations relative thereto. These rollers are used to activate the punches when the rack and gear move the inner ring. The basic difference is that the punches are activated consecutively by pistons and gears moving around the circumference of the rings and not all at one time. There also is no provision for the formation of holes or slots at differing vertical positions of the piece part being punched.

In the Nelson U.S. Pat. No. 2,423,791, the basic idea and differences are as follows: This device uses both of the conventional forms of side piercing. The first part of the device uses the activation of an outside ring by use of side action. The ram comes down connecting with the arm on the outside ring forcing it to move a certain amount radially. This in turn transfers the movement to the rollers which is the second part of the device. The rollers push the punches into the piece and the action is complete. The vertical movement of the ram does not come directly in contact with the main die resulting in any cocking of the outside ring.

In the Musser et al U.S. Pat. No. 2,630,862, the basic idea and differences are as follows: This device uses dual indexing to achieve the number of holes and spacing of these holes. This operation is much the same as a single perf. The amount makes no difference as the location does not change by movement of the part itself. The staggered effect becomes evident.

In the Patrick U.S. Pat. No. 2,875,829, the basic idea and differences are as follows: This patent is capable of making two hits in one stroke of the press in the same manner of the single hit slide cam with the action of the second bit occurring only after the first cutter is retracted but there are no mechanisms for making vertically spaced slots or holes in the workpiece.

In the Robinson U.S. Pat. No. 3,374,697, the basic idea and differences are as follows: This device is for severing a tubular member and forming a tube blank with different contours at each end. This is accomplished by shearing or punching out arcuate segments of the tubular member. The tool itself uses hydraulic pistons to activate the punches.

In the Merchant U.S. Pat. No. 3,485,124, the basic idea and differences are as follows: This device pierces the cup using the basic slide cam theory. A stationary pin is put through the punch holder. A slot is put in the movable part at whatever angle is desired. When the ram pushes down the punch slides over on the pin. As the ram travels up the punch is pulled away by the same action. The slide cam is used to activate the punches and there is no capability to simultaneously form vertically spaced holes or slots.

In the Kirchner U.S. Pat. No. 3,557,649, the basic idea and differences are as follows: This device is used for the location purpose of centering the piece part so that the opening can be pierced exactly in the right location according to the part. The piercing assembly is a hydraulic unit. One of the basic differences between this apparatus and the improvement here disclosed concerns the development of a new and improved device for the simultaneous formation of vertically spaced slots and/or holes which can be either vertically aligned or which can be vertically offset relative to one another.

In the Reider U.S. Pat. No. 3,579,767, the basic idea and differences are as follows: This device is for forming flash holes in cartridge shells. The basic slide cam is used to activate the punches to form the holes but there is no provision for the forming of vertically spaced holes and/or slots in vertical alignment or in offset alignment in the workpiece.

In the Powell U.S. Pat. No. 3,580,122, the basic idea and differences are as follows: This device is used for making knockouts in sheet plastic. The idea is to hold the box itself so that the punches (112, 114) can enter from the side to make the knockout. The means of moving the punch is the slide cam where the drive is mounted on the bottom and is activated when the ram descends down and there is no provision for the formation of vertically spaced holes or slots in-line or off-line as required.

In the Fuchs U.S. Pat. No. 3,756,108, the basic idea and differences are as follows: This device is used for cutting the circumference of tubing without leaving flashes on them. The apparatus here used activates side punches with fluid pressure and the apparatus appears unrelated to the improvements herein disclosed.

In the Jannetty U.S. Pat. No. 3,782,231, the basic idea and differences are as follows: This piercing assembly has an unusual drive for activating the pin or punch by using two arms that are controlled by a rotating crank shaft that operates to pull one arm down at a time. This operation of the crank shaft causes the fixed part of the assembly to pivot in the center thus generating side movement of the slide member to contact the part to be punched for punching.

In the Kappan U.S. Pat. No. 3,949,632, the basic idea and differences are as follows: The patent discloses a tube cut-off machine which is activated by a cam 18 for cropping off the tube. The patent does not show the improvements in a punching apparatus as herein disclosed.

In the Long, et al U.S. Pat. No. 4,269,094, the basic idea and differences are as follows: The patent discloses a device for punching holes in tubes where punches are employed for punching a single hole or a set of holes at one time. By the use of gears and ratchets, the part is then indexed. Another set of holes can then be punched. The punching apparatus has nothing to do with the improvements here disclosed.

SUMMARY OF THE INVENTION

According to the invention there is provided in a piercing die assembly for punching a plurality of radially extending holes in a tubular member, a die structure having an upper open end for receiving a tubular member to be punched and with the die structure having means for supporting the tubular member in a pre-punching position including radially inner and outer die walls for backing up inner and outer wall surfaces of the tubular member to be punched, a plurality of spaced radially movable punch assemblies operatively connected with the die structure and having a series of radially movable punches, the punch assemblies having bearings positioned at radially outer ends of the punches and with each bearing and its associated punch being radially movable simultaneously together, a vertically movable ring-shaped actuator member positioned radially outwardly of the punches and movable axially from a pre-punching position to a post-punching position, a plurality of spaced cams mounted on the ring-shaped actuator member and movable up and down therewith from a pre-punching position to a post-punching position and with the cams being positioned for contacting and actuating the bearings and the punches to punch holes in the tubular member in a preplanned manner, press means for moving the actuator member from its pre-punching position and actuating said cams to actuate the punches to punch the tubular member, each of said cams being associated in radial adjacency with an associated one of said punch assemblies and workable together for punching holes in the tubular member, means for returning said press means to its pre-punching position, and retraction means for retracting the bearings and the punches after completing a punching operation to place the punches in readiness for another punching operation.

BRIEF DESCRIPTION OF THE DRAWINGS

FIG. 5 is an enlarged fragmentary vertical section taken on line 5—5 looking in the direction indicated by the arrows as seen in FIG. 4;

FIG. 9 is an enlarged fragmentary cross-sectional view similar to FIG. 6 only illustrating a modified roller-cam and punch assembly;

FIG. 10 is an enlarged vertical section only showing a further modified cam on cam and punch assembly.

DESCRIPTION OF THE PREFERRED EMBODIMENT

Figure 1:
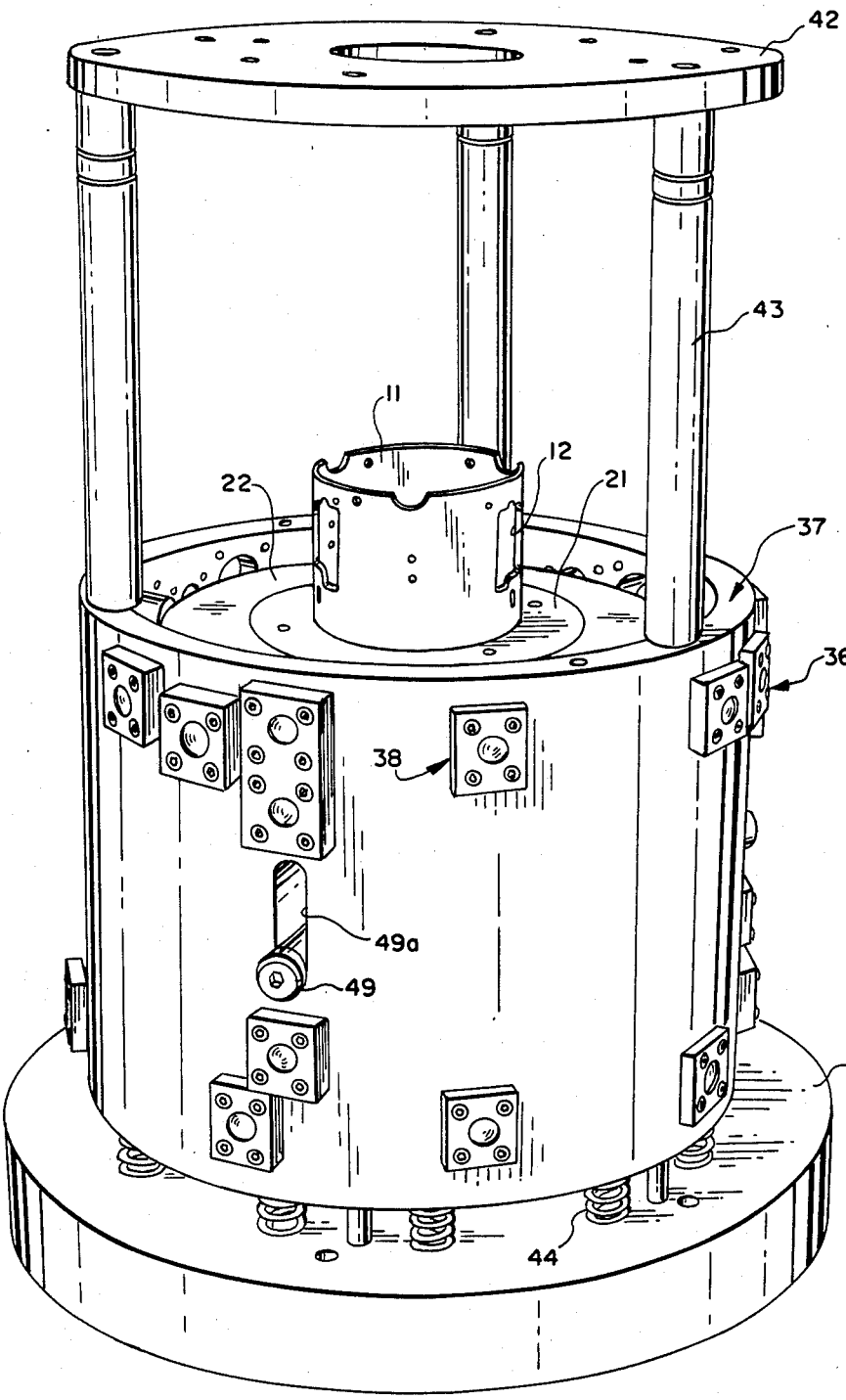
FIG. 1 is a perspective view of a preferred embodiment of a piercing die assembly embodying important features of our invention.
Figure 2:
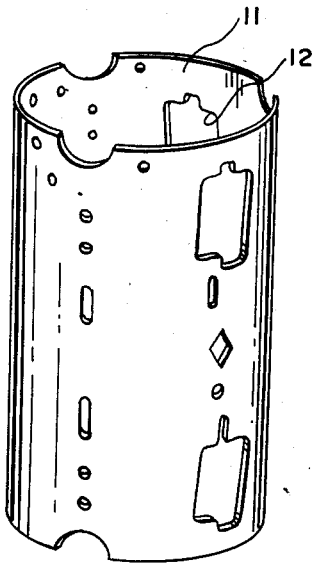
FIG. 2 is a perspective view of a punched tubular member of the type that can be punched in our piercing die assembly or machine.

The reference numeral 10 indicates generally our piercing die assembly which is specifically adapted for punching a tubular member 11 for forming radially extending holes or slots 12. These holes for slots 12 are vertically and/or circumferentially spaced relative to the tubular member 11 and can be arranged in any suitable manner, as required. The tubular member 11 can be of a variety of different overall shapes and could conceivably also be cup-shaped in configuration, round-shaped, square-shaped or shaped so as to have parallel sides, frusto-conical shaped and the like. The holes or slots 12 provided in the tubular member 11 can be of various shapes also. These shapes may be in the form of slits, round holes, irregularly-shaped slots, semi-circular slots such as where the slots are located along a top edge of the tubular member or along the bottom edge of the tubular member 11 and the like. Further, circumferentially spaced rows of vertically spaced holes or slots can now be simultaneously formed according to important features of our invention.

In order to manufacture tubular members 11 of the type just described, excellent results can be obtained by using a piercing die assembly 10 that includes an article or tubular member supporting die structure 13 having an upper open end 14 for receiving the tubular member 11 that is to be punched. As stated, the article supporting die structure 13 has a support surface or stop generally indicated at 15 for supporting the tubular member 11 in a pre-punching position. The upper open end 14 provided in the die assembly is defined by radially inner and outer die walls 16 and 17 for backing up inner and outer wall surfaces 11*a* and 12*a* of the tubular member 11 that is to be punched. The die structure itself is supported upon a base plate 19.

The piercing die assembly 10 includes a radially inner backup ring 20. Mounted concentrically with the backup ring 20 is a radially outer punch guide ring 21. It will be appreciated that the tubular member 11 is adapted to be positioned between the rings 20 and 21 and carried on support shoulder or stop 14 when the tubular member is in a pre-punching position. Mounted radially outwardly and concentric with the rings 20, and 21 is a radially outer bearing supporting ring 22. The rings 20, 21 and 22 are all disposed in concentric axially co-aligned position with respect to one another. While rings 21 and 22 are illustrated as separate elements, they can be constructed as a single unitary ring, if desired, without departing from the concepts of our invention. By making them as two rings 21 and 22, the costs of manufacture can be reduced.

Mounted upon the piercing die assembly 10 are a series of vertically and/or circumferentially spaced radially movable punch assemblies 23. These punch assemblies are located in a precise predetermined position upon the piercing die assembly 10 so as to be able to produce a predetermined punching of the piece part or tubular member 11 that is positioned in an upper open end 14 of the article supporting die structure 13.

Figure 3:
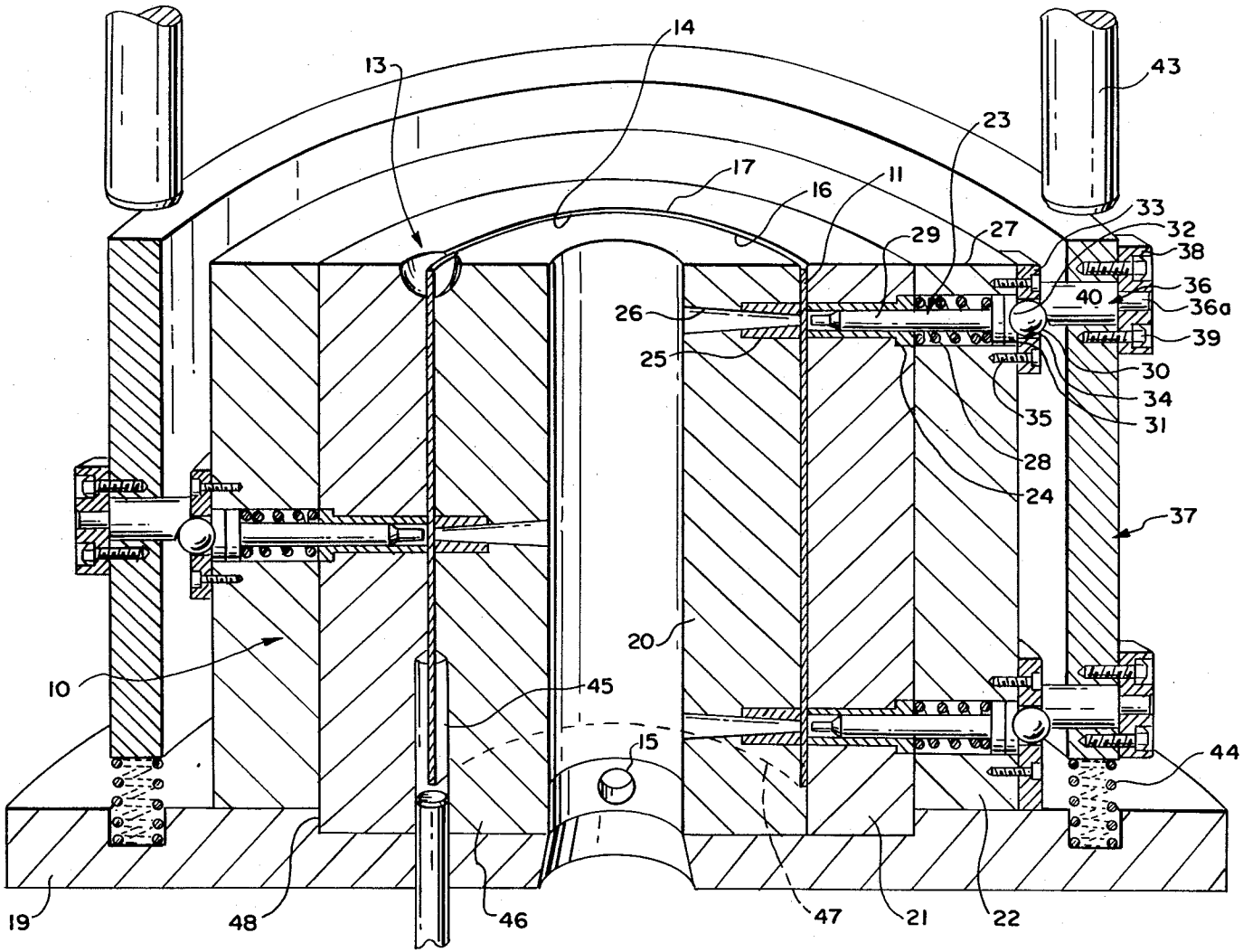
FIG. 3 is a diagrammatic vertical section of the piercing die assembly shown in FIG. 1 embodying important features of our invention.

The spaced radially movable punch assemblies 23 are each identical to one another and a description of one will suffice for all. To this end, the punch assembly 23 includes a line up bushing 24 that extends radially through the outer punch guide ring 21. Radially aligned with the bushing 24 is a die bushing 25 that is provided in a radial passageway 26 in the radially inner backup ring 20. The cam holder ring 22 also has an opening or passage 27 that is co-axially aligned with the line up bushing 24 and the die bushing 25 including passageway 26. Mounted inside of the passageway 27 is a spring 28 which operates to exert a radially outward force for returning punch 29 to a pre-punching position as is illustrated in FIG. 3. When the punch is actuated, it is caused to be forced through the tubular member 11 to thereby form the pre-determined shaped hole or slot as previously described. The punch assembly 23 also is provided with a ball bearing 30 positioned at a radially outer end of the punch 29. The ball bearing 20 is supported on a bronze hardened washer 31 which is positioned between the spring 28 and the ball bearing 30. The bronze washer 31 has a curved surface 32 that matches the confronting engaged curved surface of the ball bearing so that a nested engagement can occur. Mounted on the outside of the cam holder ring 22 is a ball bearing retainer ring 33 having an opening 34 slightly smaller than the external diameter of the ball bearing so that the ball bearing cannot escape radially outwardly of the retainer ring 33. Cap screws 35 are provided for holding the ball bearing retainer ring 33 in assembly with the cam holder ring 22. It will therefore now be percieved that if a radially inward force is applied to the ball bearing 30, that the punch 29 can be moved in its bushing 24 and be allowed to penetrate through the tubular member 11 into the die bushing 25 and the passageway 26 to effect punching.

For the purpose of actuating the ball bearing 30, we have provided a plurality of spaced outside cams generally indicated at 36. These cams 36 are mounted upon a vertically movable ring-shaped actuator member or ring 37. This ring 37 is comprised of solid metal and is actuatable by a press 42 as hereafter discussed in further detail. Also, the ring 37 has a greater diameter than outside ring 22 leaving a space S for the bearings 30 and the cams 36 to be lodged. The outside cam 36 has a reduced end 36*a* that is secured to a cam retainer ring 38 and cap screws 39 are provided to secure the cam retainer ring 38 at a radially outer side of the actuator ring 37 (FIG. 3). It will further be noted in FIG. 3 that the radially inner end of cam 36 has an arcuate cam surface 49 with a radius that generally matches the radius of a segment of the ball bearing so that the two of them can be engaged in nested relation. As the actuator ring 37 is moved axially downward in a direction towards the base plate 19, the cam 36 can ge utilized to force the ball bearing 39 radially inwardly and to thereby forceably punch the tubular member 11 by means of the punch 29. Since all of the punch assemblies and the cams are of an identical configuration insofar as the way in which the outside cam 36 engages the ball bearing 30 and insofar as the actuator ring 37 is axially moved, a $\frac{1}{2}''$ to a $\frac{5}{8}''$ stroke of a press acting through a press plate 42 and its vertically extending push pins 43 is needed to cause all of the punches to be actuated. The press plate 42 is spaced above the article supporting structure when in a pre-punching position a sufficient distance to allow the tubular member 11 to be punched and to be moved into and out of the open end before and after punching.

Once the punching operation has been completed, and upon retraction of the press, springs 44 are activated to push the actuator ring 37 vertically upwardly or axially away from the base plate 19 to cause the actuator ring to assume its pre-punching position. Thus, as the cam 36 is moved upwardly, the spring 28 and the punch assembly is activated to force the ball bearing radially outwardly from its post-punching position to its pre-punching position (FIG. 3).

Once the punch assemblies have been moved to their pre-punching positions, an air cylinder (not shown) can be activated to cause ejector pin 45 to push the tubular member 11 axially away from the base plate 19 out through the open end 14 of the drive structure 13 and the operator can then remove the punched tubular member 11 from the die assembly and insert a new tubular member to repeat the punching operation.

The radially innermost ring member 20 is mounted on an article support ring 46 which can serve also to provide a shoulder support 47 for the tubular member 11 as an assist to the stop 15. The support ring 46 is mounted on the base plate 19 radially inwardly of the base plate recess 48. The support ring 46 is disposed in radial engagement with ring 21 and both of these rings 21 and 46 are anchored in the recess 48 to securely anchor these members and to provide a solid support for the inside ring 20. In order to guide the up and down movement of the actuator ring relative to the article supporting die structure 13, the actuator ring 37 is provided with a cap screw or pin 49 that extends through an elongated slot **49*a* in the ring 37. The pin 49 is engaged in threaded engagement with the ring 22. The slot 49*a* has a length that exceeds the length of the stroke of the actuator ring when actuating the punches thus permitting free up and down movement of the actuator ring 37. The same pin and slot arrangement is provided and is illustrated on piercing die assembly 50 at 63 and 64 hereafter described. In view of the foregoing description, it will now be appreciated how a vertical piercing die can be used to eliminate many operations that were previously done on horn dies or indexing dies. Our piercing die assembly can be operated by "one shot" of the press and the punch assemblies can be thereby actuated to cause their punches to pierce as many as 100 or more holes, or slots, in round and square tubing, cups or metal boxes depending on the construction of the die structure 13. Thus, the press, acting through the press plate 42, and its push pins 43, upon a solid metal actuator ring 37 for simultaneously actuating all of the punch assemblies through the cams 36 are carried on the actuator ring 37. When the outside ring 37 is pushed down, the cams 36 which are mounted on the ring 37, push the ball bearing 30, to effect punching. The ball bearings can rotate very easily. The ball bearings push in the punches 29 which pierce the holes simultaneously. When the outside ring is moved axially away from the base plate, the springs will strip the punches out of the tubing and push the ball bearings back to their original position, making them ready for the next stroke. As previously stated, the hardened washer 31 helps maintain the punches in alignment. It will further be appreciated that the punch assembly has provided the hardened washer 31 with a radially outwardly facing washer seat for receiving the ball bearing 30. The associated bearing 30** has an arc-length that is three times the arc-length of the washer seat so that the bearing may freely turn as the cam on the outside actuator ring is engaged therewith. With regard to the seats for the ball bearing we have found that excellent operating results can be attained where certain relationships are maintained. To this end, the distance from the edge of the cam to the bottom of the radius must be three times deeper in the cam than the distance from the edge of the washer to the bottom of the washer where the ball bearing sits to allow the ball to be properly seated and to allow the ball to freely rotate. Where it is desired to pierce or punch thicker material, more tonnage may be needed and in such event, a larger size ball bearing may be required in which event the cams may be ground with a deeper radius to match the engaged surface of the ball bearing.

Figure 7:
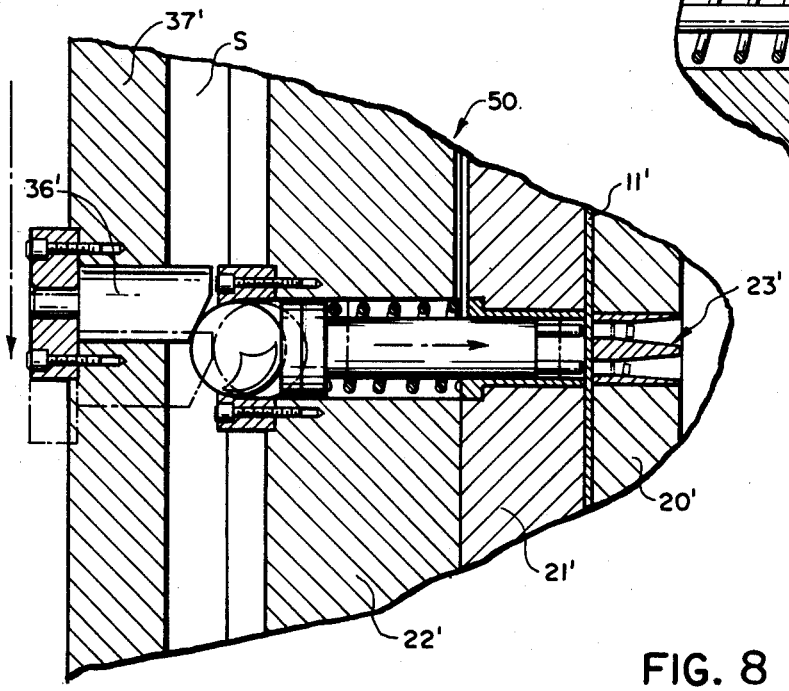
FIG. 7 is an enlarged fragmentary partially sectioned view further illustrating the cam and the punch assemblies shown in dotted and full lines showing a punching operation.
Figure 8:
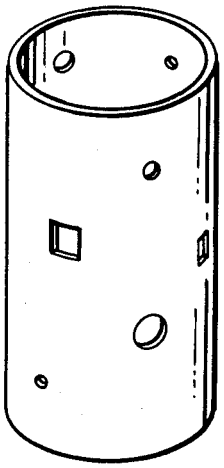
FIG. 8 is a perspective view of one type of a punched tubular member that can be punched in the piercing die assembly.

While my invention has been illustrated with ball bearings, it will also be appreciated that roller bearings and regular cams can be used as illustrated in FIGS. 7 and 8 which will be described hereafter.

Where an actuator ring 37 of the type disclosed is used, we can provide as many punches on the die structure 13 as we desire and the number of punches is only limited by the amount of space provided in the outside circumference of the die structure.

The only additional piece of equipment that is needed to operate the piercing die assembly is a regular punch press with a closed or shut height three times larger than the height of the tubular part to be punched. Where desired, a hydraulic press can be used.

Another advantage of our piercing die assembly and its construction is that there is not need to line up the die because all the rings, punches and dies are already properly aligned. All that is reqired is a downward force to push the outside actuator ring 37 to thereby cause the cams 36 to actuate the ball bearings 30 as previously described.

We have found that our piercing die assembly can hold a tolerance to ±0.001 inches and can produce at a rate of 200 pieces or more per hour.

Figure 4:
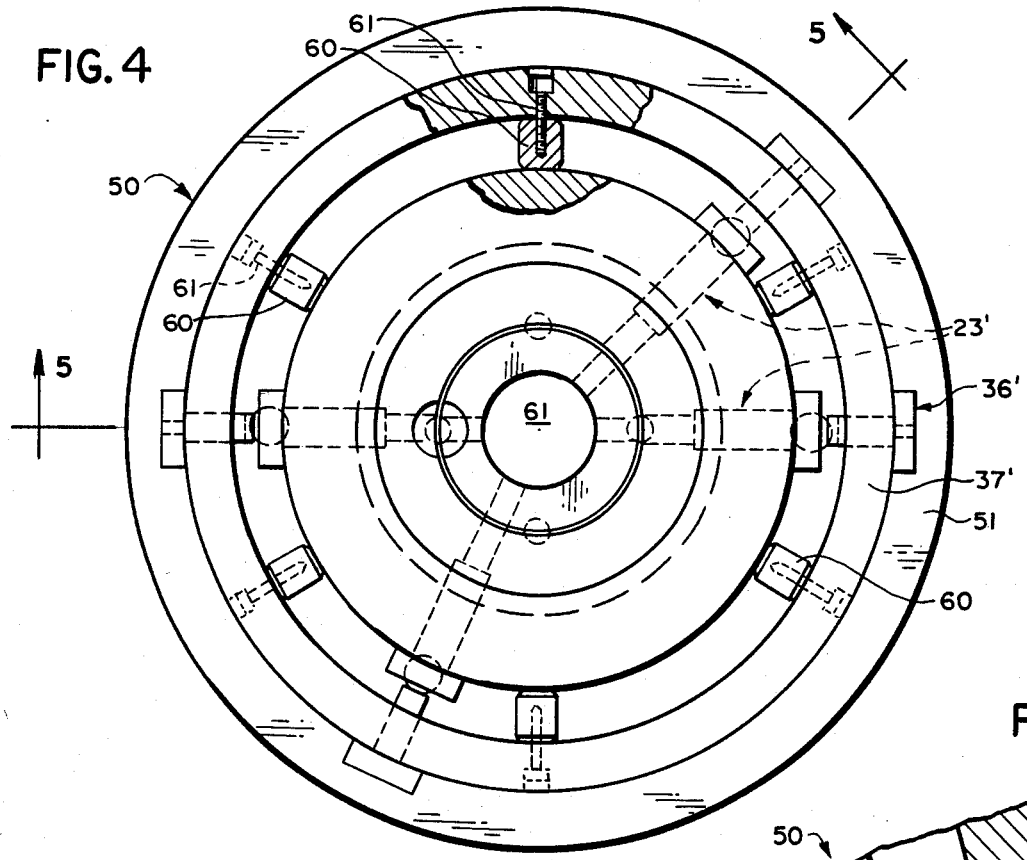
FIG. 4 is top plan view, partially in section, of a modified piercing die assembly embodying further features of our invention.
Figure 6:
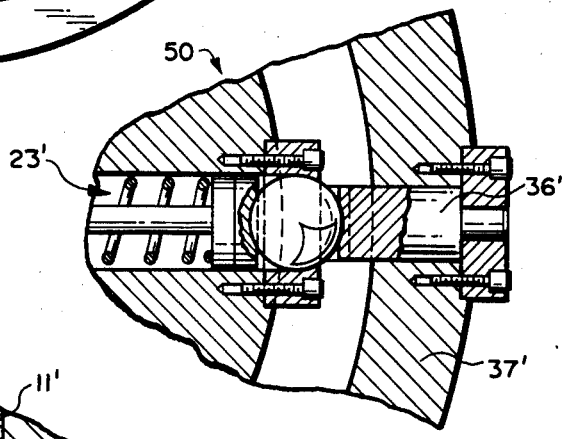
FIG. 6 is an enlarged fragmentary partially sectioned view taken on the line 6—6 in FIG. 5 and illustrating a cam and a movable punch assembly in a pre-punching position.

In FIGS. 4, 5 and 6 we have illustrated a modified type of a piercing die assembly 50 which is our preferred embodiment. The piercing die assembly 50 has many components that are identical to the piercing die assembly 10 and primed numbers have been used to designate identical or similar elements. To this end, the piercing die assembly includes the same series of concentric rings 20', 21' and 22' and the same actuator ring 37'. The piercing die assembly also includes a series of punch assemblies 23' which are actuatable by outside cams 36' carried on the actuator ring 37' and the operation is essentially the same as previously described and hence shall not be again described here with the assembly 50.

The piercing die assembly 50 differs from the piercing die assembly 10 in the way in which the rings 20', 21' and 22' are mounted as compared to the corresponding rings in the piercing die assembly 10.

While in our preferred embodiment the rings 21' and 22' have been shown as separate rings, it will be appreciated that they can be manufactured as a one-piece ring without departing from the principles of our invention. We prefer a two-ring construction as illustrated at 21' and 22' because it is easier to manufacture these rings as separate rings rather than as a single ring and also because it is less costly to do so. Still further, it is easier to adjust the components and to assemble them where the elements 21' and 22' are separately manufactured as independent rings bearing in mind that the preferred embodiment of the machine weighs approximately 1600 lbs.

More specifically, the piercing die assembly 50 has a base plate 51 supported on legs 52. The base plate 51 is thicker than the ring 19 and also is in the form of a ring. A bushing shaped support ring 53 is mounted in an opening 54 that is provided in the base plate ring 51. The ring 53 has an integral flange 55 with a diameter in excess of the hole 54 so that when the bushing shaped ring 53 is disposed in the hole 54 on the plate 51, the flange 55 abuts against a bottom side of the plate 51. Cap screws 56 are used to secure the plate 51 and the ring 53 and more particularly the flange 55 on the ring 53 in assembly together. Mounted upon the ring 53 is the inside radially innermost backup ring 20'. The radially outer punch guide ring 21' is a radially outer bearing supporting ring 22'. These rings 21' and 22' are mounted upon the base plate 51 and the cap screw 56 also serves to secure the ring 21' to the base plate 51. Another cap screw 57 serves to attach the base plate 51 and the radially outer ring 22' in assembly together. An ejector pin 45' is provided to discharge the tubular member 11' from an open end 14' so that another tubular member or part can be inserted for a repeat punching operation.

The piercing die assembly 50 can be operated in the same manner as the piercing die assembly 10 since it is provided with a press plate 42' and pins 43' which are together actuatable by a press (not shown) forcing the spring loaded actuator ring 37 in a downward direction to thereby actuate the punches 29'. During the operation of the piercing die assembly 50, should the tubular member 11' become stuck in upper open end 14' of the article support structure 13', an arcuately-shaped cutout 70 (FIG. 5) is provided so that a tool can be applied to an upper edge of the tubular member 11' to dislodge the tubular member 11' from the die assembly 50.

In order to reinforce the actuator ring 37', we have found that it is advantageous to add reinforcing or guide rails 60 and to screw them to the ring 37' by means of screws 61. This construction reduces any tendency for the press to distort the ring 37'.

The ring 37' is also physically attached to the radially outer bearing supporting ring 22' by a series of bolts 63. An elongated slot 64 is associated with each of the cap screws or bolts 63 so that the actuator ring 37' can freely move up and down in response to being depressed by the press. The bolts 63 and the slots 64 co-act to provide a guide to maintain alignment between ball bearings 30' and the cams 36'. The cap screw 63 co-acts with cap screws 65 also. These cap screws 65 serve to axially hold the actuator ring 37' in alignment with the base plate 51. Mounted externally of the cap screw 65 are springs 66 and these springs serve to return the actuator ring 37' to its normal position after being depressed during a punching operation.

For piercing thicker material, more tonnage may be needed, so a larger sized ball bearing can be used in combination with a cam having a deeper radius which can nest with the exterior surface of the ball bearing. It should be appreciated, however, that it is not absolutely necessary that ball bearings be used.

In FIGS. 9 and 10 we have shown a modified punch assembly 75 mounted on a radially outer bearing supporting ring 76 in the same manner as the punch assembly 23'. Here the way in which the punch assemblies are actuated differ in that different types of devices are used for actuating punch 77.

We have shown modified bearings 74 (FIG. 9) and 78 (FIG. 10). The bearing 74 has a roller bearing **74*a* that is engaged with a matched cam surface 80 on the outside cam 81. The outside cam is carried on the actuator ring 82 and is operable in the same manner as previously described. It will further be seen that the roller bearing 74*a* functions to work against hardened washer 79 and the spring actuated punch 77 in the same manner as previously described. Thus, this modification employs a roller 80-cam 74*a* for assisting in the actuation of the punch 77**.

In FIG. 10, a cam-on-cam type device is employed for actuating the punch and the same numerals have been used as in FIG. 9 except where different elements appear. Here a cam 83 has been substituted for the roller bearing 74 in FIG. 9. The cam 83 has a ring mounting plate 84 bolted at 85 to the ring 76. When the surfaces 80 and 85 are forcibly engaged, the punch 77 is actuated and operated as previously described.

We claim:

1. In a piercing die assembly for punching a plurality of radially extending holes in a tubular member, a die structure having an open end for receiving a tubular member to be punched and with the die structure having means for supporting the tubular member in a pre-punching position including radially inner and outer die walls for backing up inner and outer wall surfaces of the tubular member to be punched, a plurality of spaced radially movable punch assemblies operatively connected with the die structure and having a series of radially movable punches, the punch assemblies having ball bearings positioned at radially outer ends of the punches and with each bearing and its associated punch being radially movable simultaneously together, a vertically movable ring-shaped actuator member positioned radially outwardly of the punches and movable axially from a pre-punching position to a post-punching position, a plurality of spaced cams mounted on the ring-shaped actuator member and movable up and down therewith from a pre-punching position, a plurality of spaced cams mounted on the ring-shaped actuator member and movable up and down therewith from a pre-punching position to a post-punching position and with the cams being positioned for contacting and actuating the ball bearings and the punches to punch holes in the tubular member in a preplanned manner, press means for moving the actuator member from its pre-punching position and actuating said cams to actuate the punches to punch the tubular member, each of said cams being associated in radial adjacency with an associated one of said punch assemblies and workable together for punching holes in the tubular member, means for returning said press means to its pre-punching position, retraction means for retracting the bearings and the punches after completing a punching operation to place the punches in readiness for another punching operation, the vertically movable ring-shaped actuator member comprising a solid metal ring and engageable at its upper end by said press means for moving the actuator member, said press means including circumferentially spaced press rods engaged against said solid metal ring, and a press plate connected to said press rods in unitary assembly, the press plate being spaced from the article supporting structure when in a pre-punching position a sufficient distance to allow a tubular member to be punched and to be moved into and out of said open end before and after punching.

2. The piercing die assembly of claim 1 further characterized by said ring-shaped actuator member having a stroke of $\frac{1}{2}''$ to $\frac{5}{8}''$ to simultaneously actuate all of said punches.

3. The assembly of claim 1 further characterized by the punch assembly having a hardened washer with a radially outwardly facing washer seat for receiving a ball bearing, the associated bearing having an arc-length three times the arc-length of said washer seat so that the bearing may freely turn.

4. The assembly of claim 1 further characterized by the punches being positioned in at least one vertically spaced row for simultaneously punching of at least one row of the holes in the tubular member per stroke of the press means.

5. In a piercing die assembly for punching a plurality of radially extending holes in a tubular member, a die structure having an open end for receiving a tubular member to be punched and with the die structure having means for supporting the tubular member in a pre-punching position including radially inner and outer die walls for backing up inner and outer wall surfaces of the tubular member to be punched, a plurality of spaced radially movable punch assemblies operatively connected with the die structure and having a series of radially movable punches, the punch assemblies having bearings positioned at radially outer ends of the punches and with each bearing and its associated punch being radially movable simultaneously together, a vertically movable ring-shaped actuator member positioned radially outwardly of the punches and movable axially from a pre-punching position, a plurality of spaced cams mounted on the ring-shaped actuator member and movable up and down therewith from a pre-punching position to a post-punching position and with the cams being positioned for contacting and actuating the bearings and the punches to punch holes in the tubular member in a preplanned manner, press means for moving the actuator member from its pre-punching position and actuating said cams to actuate the punches to punch the tubular member, each of said cams being associated in radial adjacency with an associated one of said punch assemblies and workable together for punching holes in the tubular member, means for returning said press means to its pre-punching position, and retraction means for retracting the bearings and the punches after completing a punching operation to place the punches in readiness for another punching operation, the vertically movable ring-shaped actuator member engageable at its upper end by said press means for moving the actuator member, said press means including circumferentially spaced press rods with lower rod ends engaged against said ring-shaped actuator member, and a press plate connected to said press rods in unitary assembly, the press plate being spaced above the article supporting structure when in a pre-punching position a sufficient distance to allow a tubular member to be punched and to be moved into and out of said open end before and after punching.

6. In a piercing die assembly for punching a plurality of radially extending holes in a tubular member, a structure having an open end for receiving a tubular member to be punched and with the article supporting die structure having stop means for supporting the tubular member in a pre-punching position, the die structure including a radially inner backup ring, a radially outer punch guide ring being concentrically positioned with respect to said backup ring, and a cam holder ring being positioned radially outwardly of the backup ring and the guide ring whereby all of said rings are concentrically disposed with respect to one another, the backup ring having a radially outer die wall and the punch guide ring having a radially inner die wall which inner and outer die walls co-act for providing backup for inner and outer wall surfaces of the tubular member to be punched and further defining the aforesaid open end, the cam holder ring being positioned radially outwardly of the punches and movable axially from a pre-punching position to a post-punching position and operatively engaged with said punch guide ring, a plurality of radially spaced movable punch assemblies operatively connected with the article supporting die structure and having a series of radially movable punches, the punch assemblies having punch actuating bearings positioned at radially outer ends of the punches and with each bearing and its associated punch being radially movable simultaneously together, a plurality of spaced cams mounted on the cam holder ring and movable up and down therewith from a pre-punching position to a post-punching position and with the cams being positioned for contacting and actuating the bearings and the punches for punching holes in the tubular member in a preplanned manner, press means for moving the cam holder ring and actuating said cams to actuate the punches to punch the tubular member, each of said cams being associated in radial adjacency with an associated one of said punch assemblies and workable together for punching holes in the tubular member, means for returning said press means to its pre-punching position, retraction means for retracting the bearings and the punches after completing a punching operation to place the punches in readiness for another punching operation, the axially movable cam holder ring being comprised of solid metal and being engaged at one end by said press means for moving the cam holder ring, said cams being mounted upon said cam holder ring and being carried in spaced relation to one another when said ring is in a pre-punching position, the cams being in close proximity to one another enabling the ring to be moved a relatively short distance to complete a punching operation.

7. The assembly of claim 6 further characterized by the axially movable cam holder ring being engageable at its upper end by said press means for moving the cam holder ring, said means operatively connected with said cam holder ring for returning the same to its pre-punching position after a punching operation has been completed on the tubular member comprising a series of springs engaged with a bottom edge area of the cam holder ring.

8. The assembly of claim 6 further characterized by a bearing punch actuator ring being co-axially aligned with said ring and located radially between the punch guide ring and the cam holder ring and supporting the punch assemblies, the punch actuating ball bearings being positioned radially outwardly of the bearing punch actuation ring when in a pre-punching position.

9. The assembly of claim 6 further characterized by a bearing punch actuator ring being co-axially aligned with said ring and located radially between the punch guide ring and the cam holder ring and supporting the punch assemblies, the cam holder ring having an inside diameter in excess of an outside diameter of said bearing punch actuator ring, the cams and the bearings being operatively engageable in a radial space defined between the cam holder ring and the punch actuator ring provided due to the varying diameters.

10. The assembly of claim 6 further characterized by the radially inner backup ring comprising a bushing and having a ring shaped bushing flange at its lower end, a base plate with a plate hole having a diameter exceeding the outside diameter of the backup ring and with the ring projected through the hole and means securing said bushing flange in assembly with said base plate.

11. The assembly of claim 6 further characterized by the punches being positioned in at least one vertically spaced row for simultaneously punching at least one row of the holes in the tubular member per stroke of the press means.

12. The piercing die assembly of claim 6 further characterized by the actuator ring and the article supporting die structure having guide means therebetween to hold the actuator ring against circumferential movement relative to the article supporting structure while allowing the actuator ring to freely move up and down for actuating the punches.

13. The piercing die assembly of claim 6 further characterized by including a recessed base plate, the article supporting die structure being mounted and secured in the recess on the base plate, the article support structure including a ring shaped support plate mounted in the recess.

14. The assembly of claim 6 further characterized by the punch assembly having a hardened washer with a radially outwardly facing washer seat for receiving a ball bearing, the associated bearing comprising a ball bearing and having an arc-length three times the arc-length of said washer seat so that the bearing may freely turn.

15. The assembly of claim 6 further characterized by the punch assembly having a hardened washer at its radially outer end and with said washer being provided with a ball bearing seat, the cam having a bearing seat, the distance from the edge of the bearing seat of the cam to the bottom of the radius of the seat being three times deeper than the distance from the edge of the seat of the washer to the bottom of the washer seat where the ball bearing sits to allow the ball to be properly seated and to allow the ball to freely rotate.

16. In a piercing die assembly for punching a plurality of radially extending holes in a tubular member, a die structure having an open end for receiving a tubular member to be punched and with the die structure having means for supporting the tubular member in a pre-punching position including radially inner and outer die walls for backing up inner and outer wall surfaces of the tubular member to be punched, a plurality of spaced radially movable punch assemblies operatively connected with the die structure and having a series of radially movable punches, the punch assemblies having ball bearings positioned at radially outer ends of the punches and with each bearing and its associated punch being radially movable simultaneously together, a vertically movable ring-shaped actuator member positioned radially outwardly of the punches and movable axially from a pre-punching position to a post-punching position, a plurality of spaced cams mounted on the ring-shaped actuator member and movable up and down therewith from a pre-punching position, a plurality of spaced cams mounted on the ring-shaped actuator member and movable up and down therewith from a pre-punching position to a post-punching position and with the cams being positioned for contacting and actuating the ball bearings and the punches to punch holes in the tubular member in a preplanned manner, press means for moving the actuator member from its pre-punching position and actuating said cams to actuate the punches to punch the tubular member, each of said cams being associated in radial adjacency with an associated one of said punch assemblies and workable together for punching holes in the tubular member, means for returning said press means to its pre-punching position, retraction means for retracting the bearings and the punches after completing a punching operation to place the punches in readiness for another punching operation, the vertically movable ring-shaped actuator member comprising a solid metal ring and engageable by said press means for moving the actuator member, the punch assemblies being oriented for punching at least one series of vertically spaced holes in the tubular member, the vertically movable ring-shaped actuator member comprising a solid metal ring and engageable by said means for moving the actuator member, said means for moving the actuator member including a press plate and a series of vertically extending circumferentially spaced push pins each having an end engaged against the solid metal ring, the spaces between the push pins allowing tubular members to be inserted and removed from said open end for punching.

17. In a piercing die assembly for punching a plurality of radially extending holes in a tubular member, a structure having an open end for receiving a tubular member to be punched and with the article supporting die structure having stop means for supporting the tubular member in a pre-punching position, the die structure including a radially inner backup ring, a radially outer punch guide ring being concentrically positioned with respect to said backup ring, and a cam holder ring being positioned radially outwardly of the backup ring and the guide ring whereby all of said rings are concentrically disposed with respect to one another, the backup ring having a radially outer die wall and the punch guide ring having a radially inner die wall which inner and outer die walls co-act for providing backup for inner and outer wall surfaces of the tubular member to be punched and further defining the aforesaid open end, the cam holder ring being positioned radially outwardly of the punches and movable axially from a pre-punching position to a post-punching position and operativey engaged with said punch guide ring, a plurality of radially spaced movable punch assemblies operatively connected with the article supporting die structure and having a series of radially movable punches, the punch assemblies having punch actuating bearings positioned at radially outer ends of the punches and with each bearing and its associated punch being radially movable simultaneously together, a plurality of spaced cams mounted on the cam holder ring and movable up and down therewith from a pre-punching position to a post-punching position and with the cams being positioned for contacting and actuating the bearings and the punches for punching holes in the tubular member in a preplanned manner, press means for moving the cam holder ring and actuating said cams to actuate the punches to punch the tubular member, each of said cams being associated in radial adjacency with an associated one of said punch assemblies and workable together for punching holes in the tubular member, means for returning said press means to its pre-punching position, retraction means for retracting the bearings and the punches after completing a punching operation to place the punches in readiness for another punching operation, the axially movable cam holder ring being comprised of solid metal and being engaged at one end of said press means for moving the cam holder ring, said cams being mounted upon said cam holder ring and being carried in spaced relation to one another when said ring is in a pre-punching position, the cams being in close proximity to one another enabling the ring to be moved a relatively short distance to complete a punching operation, the axially movable cam holder ring being engageable by said means for moving the cam holder ring, said press means for moving the cam holder ring including a press plate and a series of vertically extending circumferentially spaced push pins each having an end engaged against the cam holder ring, the spaces between the push pins allowing successive tubular members to be inserted and removed from said open end for punching.

* * * * *